US010518306B2

(12) United States Patent
Memili et al.

(10) Patent No.: US 10,518,306 B2
(45) Date of Patent: Dec. 31, 2019

(54) METHOD FOR PRODUCING A STRUCTURAL ELEMENT

(71) Applicant: FORD GLOBAL TECHNOLOGIES, LLC, Dearborn, MI (US)

(72) Inventors: Selahattin Turel Memili, Aachen (DE); Igor Licko, Trnavsky kraj (SK)

(73) Assignee: Ford Global Technologies, LLC, Dearborn, MI (US)

( * ) Notice: Subject to any disclaimer, the term of this patent is extended or adjusted under 35 U.S.C. 154(b) by 470 days.

(21) Appl. No.: 15/074,098

(22) Filed: Mar. 18, 2016

(65) Prior Publication Data

US 2016/0271663 A1 Sep. 22, 2016

(30) Foreign Application Priority Data

Mar. 19, 2015 (DE) ..... 10 2015 204 931

(51) Int. Cl.
*B21H 8/00* (2006.01)
*B21B 1/22* (2006.01)

(52) U.S. Cl.
CPC ..... *B21B 1/22* (2013.01)

(58) Field of Classification Search
CPC ... B21B 1/22; B21H 8/005; B21H 8/00; B21J 15/04; B21K 25/00; F16B 17/006; F16C 11/0604; F16C 11/0695
See application file for complete search history.

(56) References Cited

U.S. PATENT DOCUMENTS 2,184,150 A * 12/1939 Parker ..... B21D 53/64 148/652
2,193,737 A * 3/1940 Penkala ..... B21B 1/09 72/128
3,209,432 A * 10/1965 Cape ..... B21C 37/065 29/417
3,877,275 A * 4/1975 Attwood ..... B21B 1/09 72/177
4,279,139 A * 7/1981 Schmitz ..... B21B 1/09 72/177

(Continued)

FOREIGN PATENT DOCUMENTS

DE 19748321 A1 5/1998
DE 19962754 A1 2/2001

(Continued)

*Primary Examiner* — David P Bryant
*Assistant Examiner* — Lawrence Averick
(74) *Attorney, Agent, or Firm* — Raymond Coppiellie; Brooks Kushman P.C.

(57) ABSTRACT

The present disclosure relates to a method for producing a structural element. A number of upper and/or lower rollers arranged one after the other in a direction of rolling is rolled in a metal strip to produce a varying thickness in the metal strip. The method includes providing the upper and/or lower rollers of each group with shape-changing profiles in the direction of rolling. The shape-changing profile of each group in each case exhibits a constant volume. The method may further include prefabricating the metal strip with partial contours produced on the basis of the shape-changing profiles to a desired final contour. The method may also include feeding the prefabricated metal strip with the desired final contour for further processing steps.

20 Claims, 2 Drawing Sheets

(56) References Cited

U.S. PATENT DOCUMENTS

| | | | | | |
|---|---|---|---|---|---|
| 4,433,565 | A * | 2/1984 | Preller | B21B 1/08 | 72/177 |
| 5,272,899 | A * | 12/1993 | Mediate | B21B 1/095 | 72/177 |
| 5,890,389 | A * | 4/1999 | Ohba | B21B 1/0805 | 72/234 |
| 5,941,114 | A * | 8/1999 | Kusaba | B21B 1/09 | 72/177 |
| 6,705,145 | B1 * | 3/2004 | Ohmae | B21D 5/06 | 72/177 |
| 2004/0107757 | A1 * | 6/2004 | Arns | C21D 1/673 | 72/185 |
| 2007/0148488 | A1 | 6/2007 | Gutermuth | | |
| 2009/0266135 | A1 * | 10/2009 | Knaup | B21D 22/02 | 72/377 |
| 2014/0193659 | A1 | 7/2014 | Lanzerath et al. | | |
| 2015/0266070 | A1 * | 9/2015 | Schneider | B21D 5/08 | 312/334.1 |

FOREIGN PATENT DOCUMENTS

| | | | |
|---|---|---|---|
| DE | 10113610 | A1 | 10/2002 |
| EP | 2111937 | A1 | 10/2009 |
| EP | 2208555 | A1 | 7/2010 |
| JP | 56151130 | S | 11/1981 |
| JP | H05123807 | | 5/1993 |
| JP | H07284873 | A | 10/1995 |
| JP | H07288473 | A | 10/1995 |
| WO | 2014075115 | A1 | 5/2014 |

* cited by examiner

METHOD FOR PRODUCING A STRUCTURAL ELEMENT

CROSS-REFERENCE TO RELATED APPLICATIONS

This application claims foreign priority benefits under 35 U.S.C. § 119(a)-(d) to DE 10 2015 204 931.0 filed Mar. 19, 2015, which is hereby incorporated by reference in its entirety.

TECHNICAL FIELD

The present disclosure relates to a method for producing a structural element, in particular for motor vehicles, by rolling a metal strip with a number of groups of upper and/or lower rollers arranged one after the other in a direction of rolling to produce the metal strip with a varying thickness.

BACKGROUND

In the production of sheet steel blanks, it is familiar from DE 199 62 754 A1 to roll metal strips flexibly in such a way that areas of different thickness arise over the length of the metal strip, e.g., tailored rolled blanks, otherwise referred to as TRBs.

EP 2 111 937 A1 discloses a method for producing flat sheet steel blanks which vary in their thickness, intended in particular for the production of component parts for motor vehicles. A sheet steel blank with a varying thickness is prefabricated as a starting workpiece. The sheet steel blank is then partially reworked by stamping with a die, so that the thickness of the sheet steel blank, which already exhibits a variable thickness, is modified locally.

A rolling process and a rolling device for producing a metal strip having a varying thickness over its width are described in EP 2 208 555 B1. Groups of rollers are traversed by the metal strip in the direction of rolling. EP 2 208 555 B1 discloses a metal strip bent from its original direction of movement in a first pass along a surface of a rolling attachment involved in the pass rolling on the metal strip to bend the metal strip beyond its yield point. This would result in an advantageous structural change in the material. However, the bending in this case would be required to take place exactly at right angles to the metal strip, so that the resistance to expansion would be reduced, which would result in a light material flow in the width direction of the material displaced during the pass.

A rolling process for the formation of single-piece rolled material that is profiled in respect to its thickness, in which the source material is formed in the width direction by rollers penetrating into the source material to a different depth over the width of the rolled material, is disclosed in DE 101 13 610 C2. It is proposed in this case that forming of the source material takes place one area at a time, and that a thickness profile that is three-dimensional and freely selectable, both in the longitudinal direction and in the width direction, is formed by the defined overlapping of the forming areas. In an illustrative embodiment for this purpose, DE 101 13 610 C2 describes a rolling device, of which the rollers are arranged one after the other in the form of a triangle, the contact surfaces of the rollers complementing one another precisely in such a way that a closed impression is introduced into the sheet steel component. DE 101 13 610 C2 further proposes that profiled rollers and rollers that are in engagement via their surface could be utilized. DE 101 13 610 C2 in any event discloses as a profiled roller those rollers which produce a groove-shaped impression.

DE 197 48 321 A1 discloses a method for rolling metal sheets, in which the metal sheets in the width direction exhibit a thin part and a thick part, which are produced in a number of steps. Each rolling step has a set consisting of a convex roller and a flat roller, the convex roller exhibiting a convex part. The thin part is formed in accordance with the extension in the width direction through the convex part of the convex roller, and the thick part is formed in accordance with the extension in the length direction through another part that is formed as the convex part of the convex roller. Sheets of different thicknesses can thus be produced transversely to the direction of rolling, although this method is not suitable in order to produce sheets of different thicknesses and shapes in the direction of rolling.

A further method for producing sheet metal profiles of different thicknesses transversely to the direction of rolling is disclosed in WO 2014 975 115 A1. The thickening of the material in this case is produced by a number of pairs of rollers lying one after the other. This method is also only suitable in order to produce sheet metal profiles of different thicknesses transversely to the direction of rolling. However, sheet metal profiles of different thicknesses and contours in the direction of rolling cannot be produced.

The increasing use of light alloys, such as aluminum, for structural elements of motor vehicles gives rise to particularly high demands in respect of the joining technology used for connecting a structural element to other components or structural elements of a motor vehicle. The selection of mechanical or thermal joining processes (pressure welding and fusion welding) for the connection of two component parts to one another is familiar in the art. In the case of mechanical joining processes, a riveted connection can be selected, for example, self-pierce riveting, otherwise referred to as SPR. Two sections for connection are placed one on top of the other for this purpose. Both component parts are deformed by a rivet, and they are thus positively connected to one another. Resistance spot welding, otherwise referred to as RSW, is a familiar thermal joining process. The two sections for connection in this case are again placed one on top of the other, and they are held between two electrodes, which usually consist of copper. A current is applied between the two electrodes, so that the local area between the two electrodes is melted.

In the mechanical method of riveted connection, appreciably high forces must be applied in order to be able to permanently establish the connection, because the assistance of heat is absent. Signs of contact corrosion because of different materials, also appear, for example, if the rivet is made of steel and the connection sections are made of aluminum, which can have an adverse effect on the durability. In the resistance spot welding method, with regard to aluminum, very high welding currents must be applied in order to be able to achieve adequate melting, which in turn can lead to a high tip wear of the copper electrodes. This requires a high energy consumption with the associated anticipated high energy costs. The high heat input can have an adverse effect on the structure of the material with respect to its durability.

A further method for producing a materially integral connection is the friction point welding process, in which the welding point is refilled, e.g., refill friction stir spot welding, otherwise referred to as RFSSW. This is a welding process in which little heat is introduced into the material. Frictional heat is generated by a rotating tool in order to plasticize the material. Welds are thus produced at about 400-450° C. in the case of aluminum alloys and, as a result, hot crack formation and high hydrogen solubility are avoided in aluminum, which exhibits a melting temperature of approx. 660° C. A low-heat joining process can be utilized in the case of aluminum alloys, in order to be able to ensure a high quality of the joint.

On balance, the resistance spot welding method is the fastest in comparison with SPR and RFSSW in terms of the time taken to establish a connection. The weld quality offered by the resistance spot welding method is not particularly good, however, as a consequence of the complete melting of the joint in the case of aluminum alloys. Although a connection by SPR is faster than a connection by RFSSW, SPR is nevertheless very unattractive because of the very considerable cost of the rivets and the possibility of contact corrosion. Furthermore, the use of multiple rivets would be required depending on the thickness of the connection point. In this respect, the connection process of RFSSW represents a particularly good alternative to the connection process by SPR. This is true in particular if the connecting surfaces decrease in thickness. Although the time taken to establish the connection is more or less the same in both the SPR and RFSSW methods, harmful contact corrosion is absent in the method by RFSSW, and the particularly high material costs of the large number of rivets is also avoided.

A feature common to all the connection methods is that the connecting surface, that is to say a peripheral flange, for example, should be as small as possible, that is to say thin. The advantages of a connecting surface that is as thin as possible include, in addition to shorter welding/joining times, a low consumption of materials as well as the achievable reduction in weight, which is advantageous in particular in the automotive industry. A metal strip having different thicknesses in the longitudinal direction is, in fact, capable of being produced in the rolling process that is familiar from the prior art. It is known, furthermore, that the metal strip can also exhibit different thicknesses in the width direction. Three-dimensional thickness profiles are also possible in this case, as shown in DE 101 13 610 C2. Multiple passes and rollers arranged both behind each other and next to each other are necessary for this purpose, however, although complicated height and positional settings are still required. In light of the foregoing, room for further improvements can still be identified in this respect in methods for producing structural elements for motor vehicles.

SUMMARY

An object of the present disclosure is thus to propose a method in which a metal strip is capable of being produced with different thicknesses in all directions, that is to say in the X direction and the Y direction. The present disclosure also has as its object, however, to propose a rolling device which is suitable for the implementation of the method.

According to the present disclosure, the task may be accomplished with a method for producing a structural element. For example, the structural element can be produced using a rolling device. Additional advantageous details may be gleaned from the present disclosure.

It should be pointed out that the characterizing features and measures that are listed individually in the following description can be combined with one another in any desired technically appropriate manner and, as a result, are able to demonstrate further embodiments of the present disclosure. The description characterizes and specifies the present disclosure additionally.

In one method for producing a structural element, in particular for a motor vehicle, the method includes a number of groups of upper and lower rollers arranged one after the other in a direction of rolling are rolled onto a metal strip so that the metal strip has a varying thickness. The metal strip in this case can exhibit a different thickness in all directions, which is to say in the X, Y and Z directions. According to the present disclosure, it is envisioned in a first step that the upper and/or lower rollers of each group are provided with shape-changing profiles in the direction of rolling, the respective shape-changing profile of each group in each case exhibiting a constant volume. The profile in this case can be applied either only on the upper roller, only on the lower roller or on the upper and lower rollers. A metal strip, which has partial contours produced on the basis of the shape-changing profiles, is prefabricated to a desired final contour in a following step. The metal strip exhibiting the desired final contour is fed for further processing steps in a subsequent step.

It is advantageous from the point of view of the present disclosure that the metal sheet is produced with the desired final contour in a continuous rolling process. Although this means that groups of upper and lower rollers arranged behind each other are envisioned, the final contour is produced in a single pass of the metal strip, a sheet with different thicknesses being rolled both in the longitudinal direction and in the transverse direction, and the thickness distribution being freely selectable, that is to say optimized.

If the metal strip is produced with the desired final contour, this can then be wound into a coil and can be fed to a further processing step in this form.

The metal strip produced with the final contour can be formed and/or hardened in a further processing step. In particular, the metal strip produced with the final contour can be hot form hardened or press hardened, e.g., using hot forming quenching, otherwise referred to as HFQ.

The metal strip produced with the final contour can be cut in a further processing step in order, for example, to obtain the structural element with its end dimensions. A laser cutting process can be used for this purpose, which permits particularly precise cuts. It is expedient if the final contour is removed in this further processing step together with a connecting surface. The connecting surface can be designated as a flange, which can be made particularly thin by the method according to the present disclosure. However, other areas of the metal strip provided with the final contour, as envisioned according to the present disclosure, are also variable in respect of their thickness.

Various structural elements for motor vehicles can thus be produced by the methods according to the present disclosure. B-pillars can be produced, for example. These exhibit thickenings, that is to say reinforcements, at their center, in order to withstand the correspondingly occurring loads. Arranged laterally thereto are the connecting surfaces or flanges, which are thinner than the area of reinforcement. The reinforcement itself can also vary in respect of its thickness, however. With the present disclosure, it is now possible to embody the area of reinforcement not only in a linear fashion, but also according to the previously calculated, most suitable reinforcement profile, and even with a curved course, where appropriate. An uneven course of the reinforcing area is also possible. In this case, by way of example only, a B-pillar when viewed from above, for example, can exhibit a larger, that is to say broader, reinforcing area on a lower area than on an upper area, the width, when viewed from above, not decreasing continuously, but also being able to increase once more after a constriction.

Other structural elements for motor vehicles can, of course, also be produced with the method according to the present disclosure.

The production of crash-optimized structural elements is also conceivable. For example, longitudinal members can be produced with the method according to the present disclosure with lower material strengths at particular, that is to say previously defined, locations, so that the component part fails at this optimized point in the event of a crash. With regard to the current approach of arranging failure points subsequently by creasing or by forming on the longitudinal member, that is to say by introducing them subsequently, the method according to the present disclosure is highly advantageous since the additional, that is to say subsequent, step is avoided. This not only has a cost-saving effect, but it also conserves energy and resources due to reduced material consumption.

The metal strip is capable of being produced by the present disclosure with the desired final contour in a single pass, in conjunction with which previously determined, three-dimensional final contours can also be produced. The rollers in this case completely overlap the metal strip transversely to the direction of rolling, the upper and lower rollers of the individual groups projecting laterally, for example, beyond the metal strip. It is possible in this way to dispense with the use of a large number of thin rollers, which follow successively one after the other and must be displaced laterally. It is possible by means of the present disclosure to utilize only a single upper roller and lower roller as a group of rollers in each case.

In the case of the roller device arranged for the implementation of the method, the upper and/or lower rollers of each group exhibit shape-changing profiles in the direction of rolling, the respective shape-changing profile of each group in each case exhibiting a constant volume.

It is expedient if the first profiled upper and/or lower roller, viewed in the direction of rolling, exhibits a narrower yet deeper profile than the subsequent upper and/or lower rollers of the following groups. It is also appropriate that the profiles of the upper and/or lower rollers following the first group of upper and/or lower rollers are respectively wider and narrower than the profiles of the upper and/or lower rollers situated upstream in the direction of rolling in each case. It is particularly beneficial in this case for the consecutive profiles to exhibit an unchanged volume, notwithstanding the changes in shape.

For the purposes of the present disclosure, this means that the upper and/or lower rollers of the first group exhibit a narrower yet deeper profile than the following group of upper and/or lower rollers, which exhibits a wider and flatter profile. In other words, the profiles are introduced as an indentation in the upper and/or lower roller. Raised areas can naturally also be envisioned, in which case, including in the case of raised areas, their volume remains constant in the direction of rolling, in which case the shape changes.

The roller nip between the upper and the lower roller is executed accordingly, that is to say adjusted. Both the lower roller and the upper roller exhibit a profile. The metal strip, after passing through the first group of upper and lower rollers, thus exhibits a subcontour, which is relatively thick and narrow, if the profile is introduced as an indentation into the roller concerned. With the passage of the metal strip, which now exhibits the subcontour, through the following groups of upper and lower rollers, the subcontour becomes increasingly wide, but also increasingly flat, which is thus also true of the metal strip. At least the last upper and lower rollers, viewed in the direction of rolling, have a width such that the rollers overlap the metal strip laterally. The final contour is capable of being produced with this last group of upper and lower rollers.

The present disclosure does not require two different or multiple method/process steps for the production of a B-pillar with thin flanges, for example. The B-pillar is produced by a continuous rolling process, e.g., it is possible for specific areas of thickness to be adjusted with consecutive rollers, so that precise cutting is only required at the end, in order to be able to obtain the desired B-pillar profile. The rollers in this case are special rollers having different contours, which exhibit defined depth ranges, so that the final form of a B-pillar can be produced in steps in "a single" process. Each succeeding group of rollers is matched one to the other and possesses a different profile, that is to say a profile with a changed shape. The profile with a changed shape is incorporated into the surface of the roller, so that an indentation is actually present. Raised areas can naturally also be envisioned.

Other advantageous details and effects of the present disclosure are described in more detail below on the basis of an illustrative embodiment that is represented schematically in the figures.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It should be emphasized that identical parts depicted in the different figures are always provided with the same reference designations, so that these are also described only once as a rule.

Figure 1:
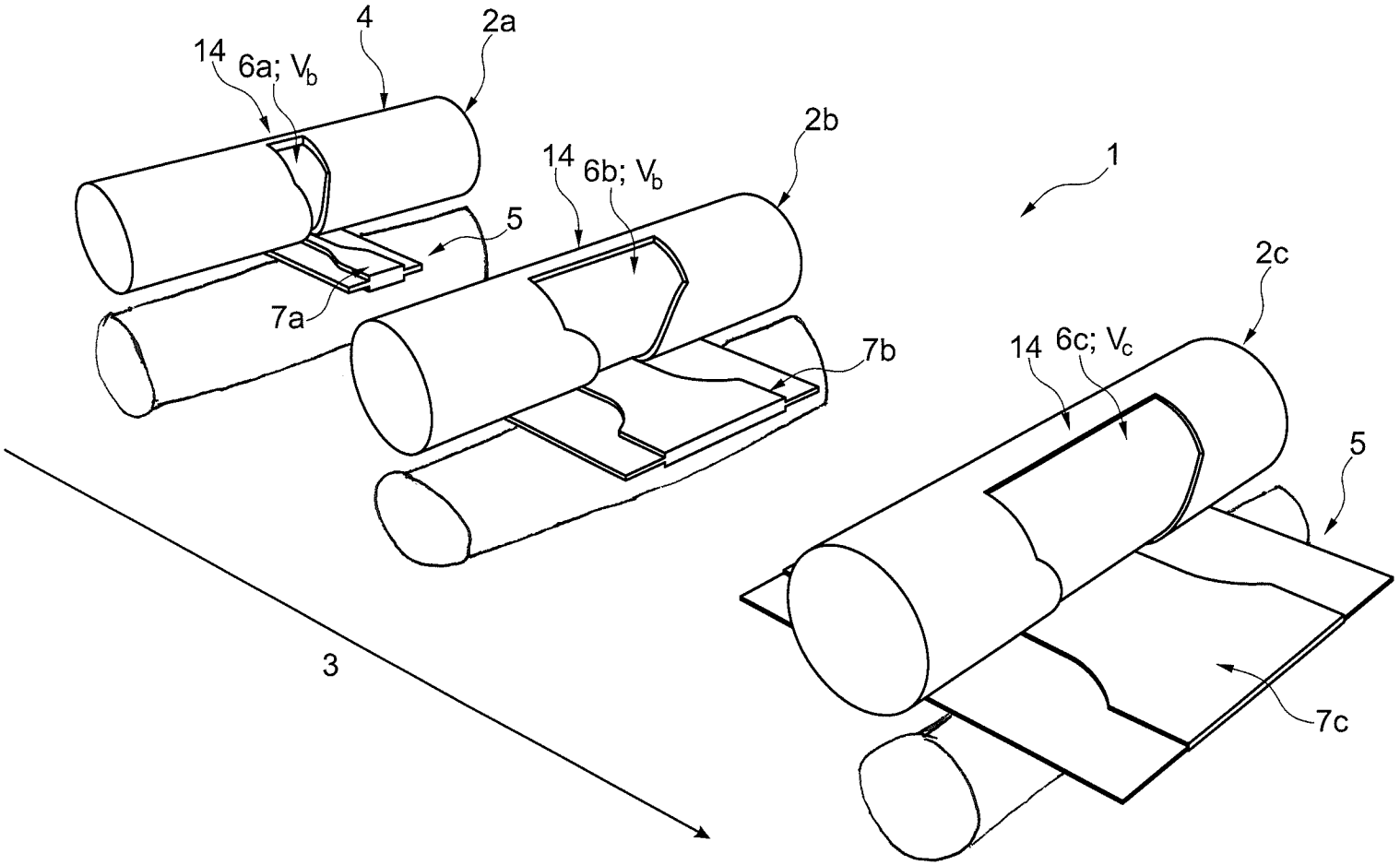
FIG. 1 depicts a roller device, of which upper rollers are represented with a profile according to the invention.

FIG. 1 depicts a roller device 1, of which only upper rollers 2 are represented. Further component parts of the roller device 1, for example frameworks and control cylinders, but also lower rollers opposite the upper rollers, are not depicted in FIG. 1. The upper rollers and lower rollers form consecutive groups 4 of upper and lower rollers in the direction of rolling (arrow 3). Formed between the upper rollers 2 and the lower rollers is a roller nip, through which a metal strip 5 passes.

The upper rollers 2, but also the lower rollers, have a profile 6, which changes in respect of its shape in each case, viewed in the direction of rolling 3, wherein the volume remains constant.

The profiles 6 are designated with 6*a*, 6*b* and 6*c* from left to right in the direction of rolling 3 in the plane of FIG. 1.

The same is true of the upper rollers 2, which are also designated with the reference designations 2*a*, 2*b* and 2*c* from left to right in the direction of rolling 3 in the plane of FIG. 1.

An identical profile 6 to the profile 6 of the upper roller 2 is introduced in the lower roller allocated in each case to the upper roller 2 concerned.

As can be appreciated, the first upper roller 2*a* has a deeper yet narrower profile 6*a*, viewed in the direction of rolling 3, than the following upper roller 2*b* in the direction of rolling 3. The profile 6*b* of the upper roller 2*b* is in turn deeper and narrower than the following profile 6*c* of the upper roller 2*c*, again in the direction of rolling 3. The volumes of the profiles 6*a*, 6*b* and 6*c* are identical, the volumes being depicted with the reference designations Va, Vb and Vc in FIG. 1. In this respect, Va=Vb=Vc is true of the invention.

It is also apparent that the upper rollers 2 project laterally above the metal strip 5 along the direction of rolling 3. The same is true of the lower rollers.

Contours 7, which are designated with the reference designations 7*a*, 7*b* and 7*c* from left to right in the direction of rolling 3 in the plane of the drawing, are produced in the metal strip 5 with the profiles 6. The contours 7*a* and 7*b* in this case should be partial contours 7*a* and 7*b*, whereas the contour 7*c* can be designated as a final contour 7*c*.

The metal strip 5 is still wider, but also thinner, viewed in the direction of rolling 3, which is also true of the contours 7*a*, 7*b* and 7*c*.

Figure 2:
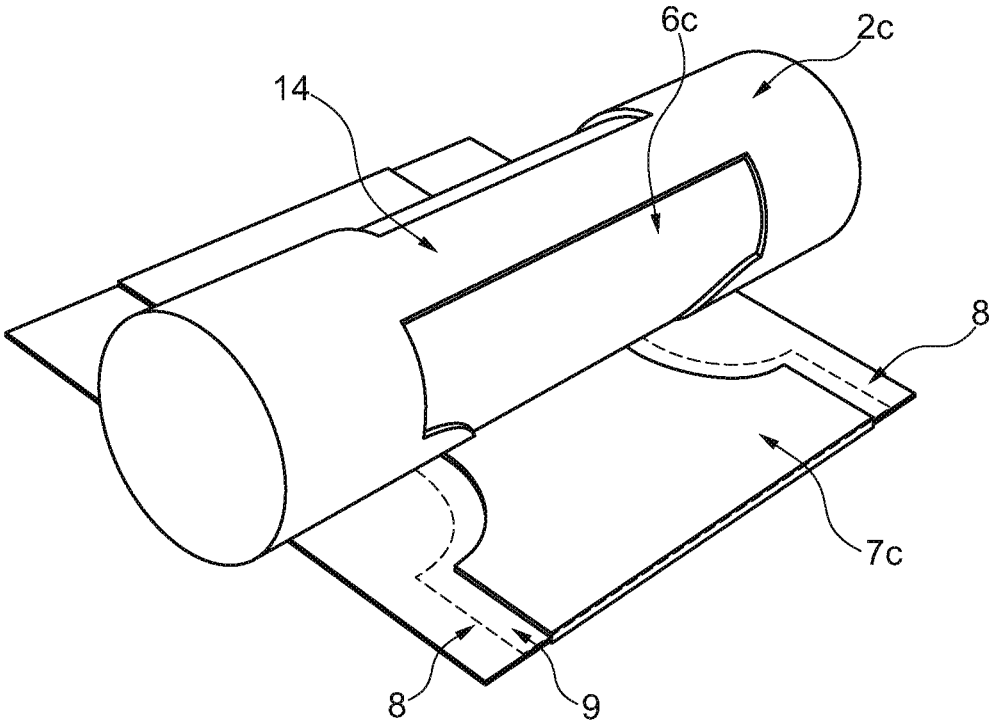
FIG. 2 depicts a metal strip with a final contour and an intended cut edge.

A structural element for a motor vehicle, which is optimized in respect of its weight and is optimized in respect of its load, is thus capable of being produced with the roller device 1 in a single rolling pass. The structural element can be of three-dimensional configuration, that is to say it can exhibit different thicknesses in each direction (X, Y, Z and/or oblique direction). This leads to a particularly reduced material consumption, as a result of which the structural element is capable of being produced virtually in its final shape in a single rolling pass, for example, in the embodiment as a B-pillar. In the illustrative embodiment in FIGS. 1 and 2, for example, a B-pillar is produced in a rolling pass, only three groups 4 of upper rollers 2 and lower rollers being represented, for example. The roller device can naturally also have more or fewer than three consecutive groups of rollers. As can be appreciated in FIG. 2, the final contour 6*c* is removed from the metal strip 5 along a precise cut edge 8 so precisely that the B-pillar, for example, can be mounted without further measures. A peripheral area, that is to say a flange or a connection surface 9, in particular can be of very thin configuration, such that a welded connection of the structural element to other components by RFSSW (refill friction stir spot welding) can be implemented particularly effectively.

Figure 3:
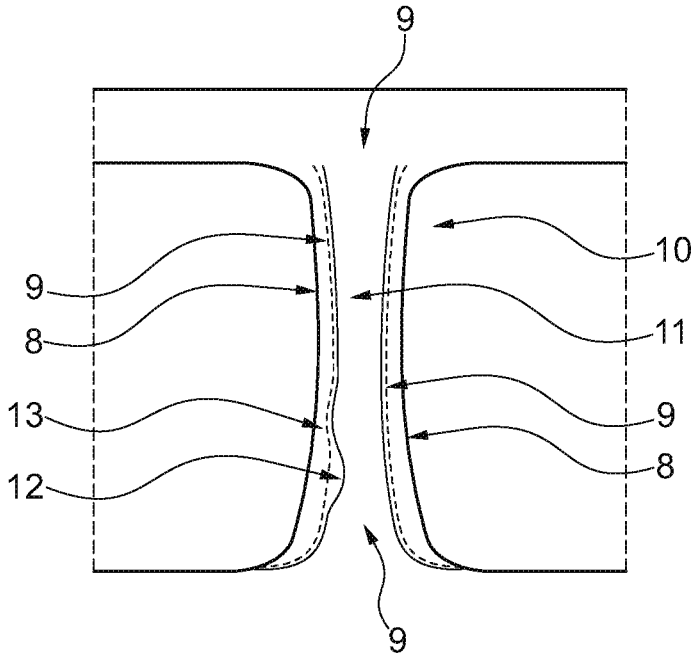
FIG. 3 depicts a structural element produced by the method according to the present disclosure and with the roller device according to the present disclosure in the embodiment as a B-pillar given by way of example.

In FIG. 3, the structural element 10 produced by the method according to an embodiment and with the roller device 1 according to the present disclosure is depicted in the embodiment given by way of example as a B-pillar, in which case a sheet is rolled having different thicknesses both in the longitudinal direction and in the transverse direction, this thickness distribution being freely selectable, that is to say optimized.

As can be appreciated in FIG. 3, in the selected top view, the embodiment given by way of example depicts the peripheral area 9 as well as a reinforcing area 11. The reinforcing area 11 exhibits a contour which changes from bottom to top in the plane of the drawing. The contour can be crash-optimized but also weight-optimized, which means that, over the vertical extent of the B-pillar viewed in the plane of the drawing, some areas are thicker than others in terms of their material strength, with failure zones acting in the event of a crash being intentionally envisioned therein. A very thin peripheral area 9 is capable of being produced in addition, which significantly reduces the welding time by RFSSW. In this case, the peripheral areas 9 arranged at the bottom and at the top respectively in the plane of FIG. 3 are produced as welding flanges with a constant thickness, for example, whereas the central part exhibits a freely selectable, that is to say optimized, thickness distribution. The contour of the B-pillar can also exhibit constrictions 12 in the reinforcing area 11, widenings 13 in turn also being embodied not only in relation to the constrictions 12. The B-pillar is produced, as represented in FIG. 3, for example, in a rolling pass with the rolling process and the roller device 1 according to the present disclosure, a precise removal from the metal strip only having been carried out along the cut edge 8 that can be discerned in FIG. 2. The cut edge 8 is indicated in FIG. 3.

The metal strip 5 can be a metal sheet or a light alloy sheet, for example an aluminum sheet. It is also apparent from FIG. 2 that the profile 6 is introduced virtually to its full extent in the upper roller 2, but also in the lower roller. Only a transitional web 14 is envisioned.

It is naturally also possible to position add-on elements, for example flanges, on the connecting surface 9 of the metal strip 5 provided with the final contour 7*c* by a welding process. Laser welding can be envisioned for the connection. This component part can be solution annealed and quenched, in order to be able to retain the material characteristics, for example, of the aluminum used as a material.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method comprising:

providing first and second rollers having first and second recessed profiles, respectively, having first and second volumes, respectively, the first profile being deeper and narrower than the second profile and the first and second volumes being the same;

applying the first profile and subsequently the second profile to a metal strip to form a contour on the metal strip; and producing a structural element from the metal strip having the contour.

2. The method of claim 1 wherein the applying step includes rolling the first and second profiles onto the metal strip.

3. The method of claim 1 wherein the applying step includes producing the metal strip with the contour so that it has a varying thickness.

4. The method of claim 1 wherein the first and second rollers includes a first and second upper and lower rollers, respectively.

5. The method of claim 1 wherein the applying step includes a continuous rolling process.

6. The method of claim 1 wherein the structural element is wound into a coil.

7. The method of claim 1, further comprising hardening the metal strip having the contour to produce the structural element.

8. The method of claim 1, further comprising cutting the metal strip having the contour to produce the structural element.

9. The method of claim 1, further comprising removing the contour and a connecting surface from the metal strip.

10. The method of claim 9 wherein the removing step is performed via cutting.

11. A method comprising:

providing first and second rollers having first and second recessed profiles, respectively, having first and second volumes, respectively, the first profile being deeper and narrower than the second profile and the first and second volumes being the same;

applying the first profile to a metal strip to form a partial contour on the metal strip;

applying the second profile to the partial contour to form a final contour; and producing a structural element from the metal strip having the final contour.

12. The method of claim 11, wherein each of the first and second recessed profiles has an hourglass shape.

13. The method of claim 11, wherein each of the first and second recessed profiles is an indentation.

14. The method of claim 11, wherein during the applying steps, the first and second rollers completely overlap the metal strip transversely to a direction of rolling.

15. The method of claim 11, wherein each of the first and second recessed profiles has a bottom surface bounded by a peripheral surface.

16. A method comprising:

providing first, second, and third rollers having first, second, and third recessed profiles, respectively, having first, second, and third volumes, respectively, the first profile being deeper and narrower than the second profile, the second profile being deeper and narrower than the third profile, and the first and second volumes being the same;

applying the first profile to a metal strip to form a first partial contour on the metal strip;

applying the second profile to the first partial contour to form a second partial contour;

applying the third profile to the second partial contour to form the final contour; and producing a structural element from the metal strip having the final contour.

17. The method of claim 16, wherein each of the first, second, and third recessed profiles has an hourglass shape.

18. The method of claim 16, wherein each of the first, second, and third recessed profiles is an indentation.

19. The method of claim 16, wherein during the applying steps, the first, second, and third rollers completely overlap the metal strip transversely to a direction of rolling.

20. The method of claim 16, wherein each of the first, second, and third recessed profiles has a bottom surface bounded by a peripheral surface.

* * * * *